United States Patent [19]

van Bilderbeek

[11] 4,130,076

[45] Dec. 19, 1978

[54] SINGLE POINT MOORING APPARATUS

[75] Inventor: Ben H. van Bilderbeek, Ventura, Calif.

[73] Assignee: Vetco, Inc., Ventura, Calif.

[21] Appl. No.: 778,483

[22] Filed: Mar. 17, 1977

[51] Int. Cl.[2] ..... B63B 21/00

[52] U.S. Cl. ..... 114/230; 9/8 P

[58] Field of Search ..... 9/8 P; 114/230, 264, 114/256, 257; 61/94, 95; 141/279, 387, 388; 137/236; 285/18

[56] References Cited

U.S. PATENT DOCUMENTS

| | | | |
|---|---|---|---|
| 3,321,217 | 5/1967 | Ahlstone | 285/18 |
| 3,557,396 | 1/1971 | Rupp | 9/8 P |
| 3,641,602 | 2/1972 | Flory et al. | 9/8 P |
| 3,894,567 | 7/1975 | Mott et al. | 9/8 P X |

OTHER PUBLICATIONS

Flory; J. F., Mascenik; J., & Pedersen; K. I. *The Single Anchor Leg Mooring,* Exxon Research and Engineering Company, P.O. Box 55, Linden, N.J. 07036, Jul. 1975.

*Primary Examiner*—Trygve M. Blix
*Assistant Examiner*—Sherman D. Basinger
*Attorney, Agent, or Firm*—Pravel, Wilson & Gambrell

[57] ABSTRACT

A single point mooring apparatus for loading a tanker from a sub-sea source including surface and submerged flotation chambers connected by a hollow mooring line which has its lower end releasably connected to a permanent pile anchor in the ocean bottom. Flexible flowlines are connected to the surface buoy for transferring fluids to the ship and a ship mooring hawser is connected from below the surface for securing the ship to the mooring apparatus.

4 Claims, 1 Drawing Figure

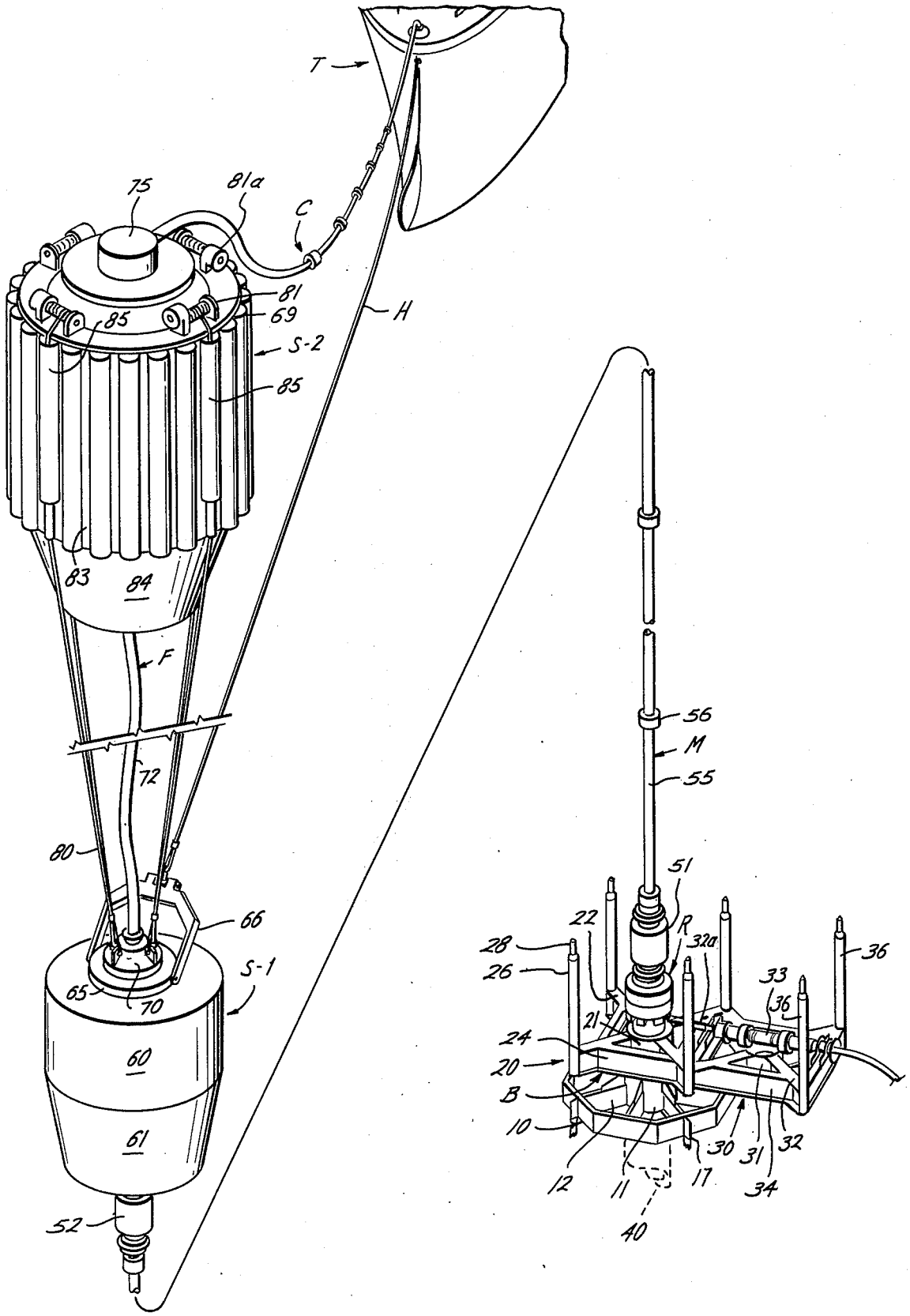
T
75
81a
C
81
69
H
85
S-2
85
83
84
F
72
80
66
S-1
65
70
60
61
52
56
M
55
51
R
22
32a
28
26
36
33
36
21
24
20
B
10
30
31
32
12
11
17
34
40

SINGLE POINT MOORING APPARATUS

BACKGROUND OF THE INVENTION

Heretofore various single point mooring terminals have been proposed; some using a free floating buoy tethered to the bottom by a chain or chains with submerged flexible hoses extending from the bottom to the surface for conducting fluids to a tanker and others have used a rigid riser with a submerged buoyant chamber in conjunction with a rigid mooring yoke for conducting fluids from the marine riser to a tanker. Other terminals have used a riser leading from a submerged buoy with submerged hoses conducting fluid to the tanker from a buoyant chamber and the riser.

SUMMARY OF THE INVENTION

The present invention provides a new and improved single point mooring system for mooring a tanker in deep water and providing a connection for pumping fluid to or from a sub-sea supply or storage facility. The apparatus includes a hollow metal mooring tube or pipe having flexible joints at either end and means for releasably connecting the lower end to the ocean bottom by a landing base which is secured in place on a piling that is jetted or cemented in place by conventional drilling means. The base mounts a releasable connector profile for releasably connecting the hollow mooring connector to permit it to be removed when desired. The hollow mooring extends upwardly to a flexible joint carried by submerged buoy to which the tanker is moored. The upper end of the tubular mooring is connected to a surface buoy through a flexible hose from which the buoyant product lines or connecting hoses extend to the ship.

The single point mooring system of the present invention can be positioned on the bottom at substantial depths and operated for transferring oil or other petroleum products to or from a tanker tethered to the buoy. Should it be desired to move the single point mooring system to another location, the releasable connection at the lower end of the tubular mooring can be disconnected and the mooring string and the buoys attached thereto can be retrieved and installed at some other location.

BRIEF DESCRIPTION OF THE DRAWING

The drawing is an exploded, schematic illustration showing the single point mooring apparatus with a tanker moored to it.

DESCRIPTION OF THE PREFERRED EMBODIMENT

The apparatus of the present invention, designated generally A in FIG. 1 of the drawing, comprises a base B which is positioned on the ocean bottom, a mooring pipe or tube M which extends upwardly to a submerged buoy S-1, which is connected at its lower end by a releasable connector R to a pile joint extension profile which is housed in base B and at its upper end by a flexible hose F to a surface buoy S-2. A fluid conduit C extends from the surface buoy S-2 for connection to a tanker T which is moored to the submerged buoy S-1 by means of a suitable hawser H.

With this apparatus, a tanker T may be connected to the single point mooring system hawser H and the flexible hose C to load or discharge through the mooring pipe M to a suitable storage facility at or beneath the ocean bottom.

Considering now the apparatus of the invention in more detail, the landing base B preferably comprises a temporary guide base, designated generally 10, having a central cylindrical body 11 with a plurality of radially extending arms 12 projecting laterally therefrom. The inner ends of the arms are welded to the central cylindrical body 11 and the outer ends have transversely extending T-head members 14 welded thereto. The ends of adjacent T-heads are welded together to form a perimeter skirt which surrounds the central body 11 and, in the preferred form shown, forms a hexagon shape. However, it will be appreciated that the number of laterally projecting arms 12 could vary and that the configuration of the outer perimeter could also vary without departing from the scope of the present invention. Also, as shown, vertical stakes 17 are connected to the perimeter sides to position the temporary base 10 when it is initially set on the ocean bottom and for connecting guide cables (not shown).

A permanent guide structure 20 is positioned on the temporary guide base 10 and secured thereto with the pile section. As shown, such permanent guide structure includes a central conductor housing 21 to which a plurality of radially extending beams or fingers 22 are welded. Adjacent arms 22 are connected by transverse I-beams 24. The outer ends of the arms have upwardly extending guide posts 26 which are provided with connectors 28 for connecting guide cables thereto. The guide structure shown also includes a frame 30 for mounting a remote pipeline connector 33. The pipeline connector 33 includes a stub pipe **33*a* which is welded in the pile extension profile 42 and provides a fluid connector to the mooring string M. Such pipeline frame guide is substantially identical to the guide structure 20 and includes a central housing 31 with radial fingers 32 welded thereto, with transverse I-beams 34 connecting adjacent fingers and with guide posts 36 extending upwardly from the outer ends of the fingers 32. A gimballed connection may be provided between the temporary guide base and the permanent guide structure for automatically compensating for a sloping bottom; however, it will be appreciated that the permanent guide structure could be used without the temporary guide base and can be readily adapted for either drilling or jetting in the piling string 40. In either event, the piling string 40** is mounted in a receptacle on the permanent guide base and extends downwardly through the conductor housing into the seabed below the guide base or bases where it is cemented in place.

The pile extension profile 42 extends upwardly from conductor housing 21 and is connected in a hydraulically actuated connector R which is of the type shown and described in detail in U.S. Pat. No. 3,321,217. The upper end of the hydraulic connector mounts a flexible joint 51 which is of the type shown, for example, in U.S. Pat. No. 3,746,372. A plurality of joints of mooring pipe 55 are connected together end-to-end by riser connectors 56 which are of the type for example shown in U.S. Pat. No. 3,827,728 or other suitable tubular connectors to make up the mooring string M for use in conducting fluids between the ocean bottom and the submerged buoy S-1.

The upper end of riser mooring M is connected to the upper flexible pipe joint 52 which is identical to the lower flexible pipe joint 51. The upper end of flexible pipe joint 52 is connected to a length of mooring pipe which extends through an axial opening formed in the submerged buoy S-1 and is suitably secured to such buoy.

Such submerged buoy S-1 comprises a cylindrical upper body 60 and a truncated conical body 61. As shown, a swivel connector 65 mounted on the top of the submerged buoy S-1 pivotally mounts yoke 66 to which mooring hawse H is connected. The swivel connector permits a tanker T to swing freely about the mooring when secured to the yoke by means of the hawse H.

A cable connector collar 70 is positioned on top of the submerged buoy S-1 for receiving the cables 80 which are wound on drums or reels 81 mounted on the surface buoy S-2. The reels have hydraulic motors 81*a* for rotating the reels to take up or let out the cable, as desired. Such surface buoy which has a cylindrical upper body 83 and a truncated conical lower body 84 has an axial opening through which the flexible hose 72 extends and to which the buoy is secured by suitable means.

The cables 80 are circumferentially spaced, preferably 90° apart, on the buoy and pass through guides 85 which extend along the sides of the cylindrical body. The cables can be shortened or lengthened by rotating the reels 81 to control the displacement of the upper buoy S-2 and thus control the tension applied to the mooring pipe therebelow. Also, as shown, fenders 69 are spaced circumferentially of the buoy to protect the cylindrical body against impact from ships, tugs or the like.

The upper end of the mooring pipe M projects through the collar 70 and is connected to a flexible hose or conduit 72 which connects the upper end of the mooring pipe M and the swivel top 75 which is suitably attached in a rotating fashion to surface buoy S-2. Flexible hose 72 accommodates some variation in the elevation or vertical distance between the surface buoy S-2 and the submerged buoy S-1 as the cables 80 are lengthened or shortened as the case may be. A swivel top or cap 75 is rotatably mounted at the upper end of the mooring pipe to connect to flowline or conduit C to permit the mooring hawse H and the conduit C to swing together as the tanker swings freely about such mooring S-2.

It will be appreciated that with the single point mooring system of the present invention the buoys and mooring pipe may be positioned at a desired location in the ocean by placing a temporary guide structure on the bottom and jetting or cementing a pile in place. Together with the pile the permanent guide base is positioned on the temporary guide base and the mooring string M, including the hydraulic connector R, the upper and lower flex joints 52 and 51, as well as the surface and submerged buoys S-2 and S-1, may be lowered into position and connected to the pile extension profile 42. Also, it will be appreciated that the remote pipeline connector may be connected to a suitable flowline on the ocean bottom for transferring product through the mooring pipe to or from a tanker at the surface. After this single point mooring has served its usefulness, should it be desired to move the single point mooring to another location, the hydraulic connector R at the lower end of the mooring line can be disconnected and the mooring line and its associated buoys and flex joints can thereafter be retrieved and reinstalled at some other suitable location.

The foregoing disclosure and description of the invention are illustrative and explanatory thereof, and various changes in the size, shape, and materials, as well as in the details of the illustrated construction may be made without departing from the spirit and scope of the invention.

What is claimed is:

1. A single point mooring apparatus for mooring a ship and conducting fluid thereto, comprising:
   - a guide base positioned on the ocean floor and connected to a pile embedded in the ocean bottom;
   - a hollow tubular conductor pipe extending upwardly from said base and connected thereto by a releasable connector;
   - a submerged buoy mounted with said conductor pipe adjacent its upper end;
   - a surface buoy connected to said submerged buoy by adjustable connector means for controlling the tension on said hollow tubular conductor pipe;
   - a flexible conduit connecting the upper end of said conductor pipe and a fluid flowline extending from said surface buoy for delivering fluids from said hollow tubular conductor pipe to a tanker; and
   - a rotatable ring mounted for rotation about said flexible conduit and having a yoke pivotally connected to said ring for receiving a hawse for mooring a tanker to said submerged buoy.

2. The invention of claim 1, wherein:
   said adjustable connector means connecting said surface buoy and said submerged buoy comprises a plurality of cables wound on reels on said surface buoy with the free end of the cables connected to said submerged buoy and drive means for rotating said reels in either direction for taking up or playing out said cables to control the displacement of said surface buoy.

3. The invention of claim 1, including:
   a lower flexible joint connecting said tubular conductor pipe and said releasable connector.

4. The invention of claim 1, including:
   an upper flexible joint connecting said tubular conductor pipe and said submerged buoy.

* * * * *